US009082352B2

(12) United States Patent
Cheng et al.

(10) Patent No.: US 9,082,352 B2
(45) Date of Patent: Jul. 14, 2015

(54) ELECTRO-PHORETIC DISPLAY APPARATUS AND DRIVING METHOD THEREOF

(75) Inventors: Ping-Yueh Cheng, Taoyuan County (TW); Chun-An Wei, New Taipei (TW); Wen-Pin Chiu, Taoyuan County (TW); Feng-Shou Lin, Tainan (TW)

(73) Assignee: SiPix Technology Inc., Taoyuan (TW)

( * ) Notice: Subject to any disclaimer, the term of this patent is extended or adjusted under 35 U.S.C. 154(b) by 182 days.

(21) Appl. No.: 13/225,486

(22) Filed: Sep. 5, 2011

(65) Prior Publication Data

US 2012/0098817 A1 Apr. 26, 2012

(30) Foreign Application Priority Data

Oct. 20, 2010 (TW) ..... 99135775 A

(51) Int. Cl.
*G09G 5/00* (2006.01)
*G09G 3/34* (2006.01)

(52) U.S. Cl.
CPC ..... *G09G 3/344* (2013.01); *G09G 2300/08* (2013.01); *G09G 2310/0251* (2013.01); *G09G 2310/0256* (2013.01)

(58) Field of Classification Search
CPC ..... G09G 3/344; G09G 2310/0256; G09G 2310/0251; G09G 2300/08
USPC ..... 345/30, 36, 45–54, 76–107, 204–215
See application file for complete search history.

(56) References Cited

U.S. PATENT DOCUMENTS

| | | | | |
|---|---|---|---|---|
| 6,762,744 | B2 * | 7/2004 | Katase | 345/107 |
| 2004/0145550 | A1 * | 7/2004 | Chen et al. | 345/87 |
| 2006/0001630 | A1 * | 1/2006 | Chen et al. | 345/96 |
| 2008/0303773 | A1 * | 12/2008 | Chen | 345/96 |
| 2009/0184912 | A1 * | 7/2009 | Eun et al. | 345/94 |
| 2010/0134473 | A1 * | 6/2010 | Matsuda et al. | 345/213 |
| 2010/0182292 | A1 * | 7/2010 | Kouno | 345/205 |
| 2010/0271294 | A1 * | 10/2010 | Chen et al. | 345/99 |
| 2010/0277406 | A1 * | 11/2010 | Choi et al. | 345/96 |

FOREIGN PATENT DOCUMENTS

| | | |
|---|---|---|
| TW | 200707364 | 2/2007 |
| TW | 200739507 | 10/2007 |

OTHER PUBLICATIONS

"Office Action of Taiwan Counterpart Application", issued on Jun. 27, 2013, p. 1-p. 8.

* cited by examiner

*Primary Examiner* — Christopher E Leiby
(74) *Attorney, Agent, or Firm* — Jianq Chyun IP Office

(57) ABSTRACT

A driving method for an electro-phoretic display apparatus is disclosed. The method includes generating a common voltage by a common voltage generator held at a first voltage level before a polarity transfer, generating the common voltage held at a second voltage level when the polarity transfer starts during a first timing period, and generating the common voltage transfers held at a third voltage level during a second timing period after the first timing period, in which the second voltage level is between the first and the third voltageE levels.

4 Claims, 4 Drawing Sheets

ELECTRO-PHORETIC DISPLAY APPARATUS AND DRIVING METHOD THEREOF

CROSS-REFERENCE TO RELATED APPLICATION

This application claims the priority benefit of Taiwan application serial no. 99135775, filed on Oct. 20, 2010. The entirety of the above-mentioned patent application is hereby incorporated by reference herein and made a part of this specification.

BACKGROUND OF THE INVENTION

1. Field of the Invention

The invention generally relates to an electro-phoretic display apparatus and a driving method thereof.

2. Description of Related Art

With the increasing advancements in electronic technologies nowadays, the electronic paper has become a new generational product popular for enabling a user to have a convenient information reading experience. By using electronic paper technology, people no longer have to carry heavy and voluminous books or magazines in order to peruse a large quantity of information. Among the electronic paper technologies, the electro-phoretic display apparatus is a common and popular implementation.

Please refer to FIG. 1A, which schematically illustrates an electro-phoretic display apparatus. In an electro-phoretic display apparatus 100, the brightness and the color of the display apparatus is determined by a relative position of a plurality of particles 120 in an inter-medium 110. The relative position is determined by a pixel driving voltage 130 applied on the electro-phoretic display apparatus 100. Please also refer to FIG. 1B, which illustrates a relational diagram of particle position and time under different pixel driving voltages. As shown by the curves 140 and 150 depicted in FIG. 1B, after a same time T, the particles are displaced farther under a higher pixel driving voltage (i.e., P2>P1). The curve 150 is a relational curve of the particle position and time when the pixel driving voltage is 1 V, and the curve 140 is a relational curve of the particle position and time when the pixel driving voltage is 2 V.

Please refer to FIG. 1C, which illustrates a waveform relational diagram of a common voltage VCOM and the pixel driving voltages Line1 and LineN of a conventional electro-phoretic display apparatus. When the alternating current (AC) common voltage VCOM transitions due to a polarity transfer, a first row of pixel driving voltage Line1 is almost synchronous with the common voltage VCOM with no phase delay, whereas a last row (e.g., an Nth row, where N is a positive integer) of the pixel driving voltage LineN generates a specific delay. Accordingly, the common voltage VCOM and the last row of the pixel driving voltage LineN generate a specific level of voltage difference in a region A1. This voltage difference state appears repetitiously due to the repeating polarity transfer operations of the electro-phoretic display apparatus. Therefore, the particles in the electro-phoretic display apparatus are unnecessarily displaced, thereby causing an image fading phenomenon.

SUMMARY OF THE INVENTION

The invention is directed to providing two electro-phoretic display apparatuses and a driving method thereof, for effectively lowering a voltage difference between a pixel data signal and a common voltage generated while performing a polarity transfer, and thereby reducing an image fading phenomenon.

The invention provides a driving method of an electro-phoretic display apparatus, including providing a common voltage generator for generating the common voltage held at a first voltage level before the polarity transfer. Thereafter, the common voltage generator is provided for generating the common voltage held at a second voltage level when the polarity transfer starts during a first timing period. Moreover, the common voltage generator is provided for generating the common voltage held at a third voltage level during a second timing period after the first timing period, so as to complete the polarity transfer, in which the second voltage level is between the first voltage level and the third voltage level.

According to an embodiment of the invention, the first voltage level is higher than the third voltage level, or the third voltage level is higher than the first voltage level.

According to an embodiment of the invention, the driving method further includes providing a source driver for generating a plurality of pixel data signals. The source driver generates each of the pixel data signals of an original voltage level before the polarity transfer, and generates each of the pixel data signals held at a middle voltage level during the first timing period. Moreover, the source driver generates each of the pixel data signals held at a post-transition voltage level during the second timing period, so as to complete the polarity transfer.

According to an embodiment of the invention, the middle voltage level is between the original voltage level and the post-transition voltage level.

The invention provides a driving method for an electro-phoretic display apparatus, in which the electro-phoretic display apparatus has a plurality of pixel units, and each of the pixel units receives a pixel data signal. The driving method includes providing a source driver for generating each of the pixel data signals held at an original voltage level before a polarity transfer. A common voltage generator is provided for generating each of the pixel data signals held at a middle voltage level when the polarity transfer starts during a first timing period. Moreover, the common voltage generator is provided for generating each of the pixel data signals held at a post-transition voltage level during a second timing period after the first timing period, so as to complete the polarity transfer, in which the middle voltage level is between the original voltage level and the post-transition voltage level.

According to an embodiment of the invention, the original voltage level is higher than the post-transition voltage level, or the post-transition voltage level is higher than the original voltage level.

The invention further provides an electro-phoretic display apparatus including a plurality of pixel units, a common voltage generator, and a source driver. The pixel units collectively receive an AC common voltage, and each of the pixel units receives a pixel data signal. The common voltage generator is coupled to the pixel units for generating the common voltage held at a first voltage level before a polarity transfer, generating the common voltage held at a second voltage level when the polarity transfer starts during a first timing period, and generating the common voltage held at a third voltage level during a second timing period after the first timing period, so as to complete the polarity transfer. Moreover, the second voltage level is between the first voltage level and the third voltage level. The source driver is coupled to the pixel units for generating the pixel data signals.

The invention provides an electro-phoretic display apparatus including a plurality of pixel units, a common voltage generator, and a source driver. The pixel units collectively receive an AC common voltage, and each of the pixel units receives a pixel data signal. The common voltage generator is coupled to the pixel units for generating the common voltage. The source driver is coupled to the pixel units for generating each of the pixel data signals of an original voltage level before a polarity transfer, generating each of the pixel data signals held at a middle voltage level during a first timing period, and generating each of the pixel data signals held at a post-transition voltage level during a second timing period, so as to complete the polarity transfer.

In summary, according to an embodiment of the invention, while the electro-phoretic display apparatus performs the polarity transfer, by generating and maintaining the pixel data signals or the common voltage at a middle voltage level for a timing period, when at least one of the pixel data signals or the common voltage transitions, the voltage difference generated between the pixel data signals and the common voltage can be effectively lowered, and thereby the image fading phenomenon can also be reduced.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 2A:
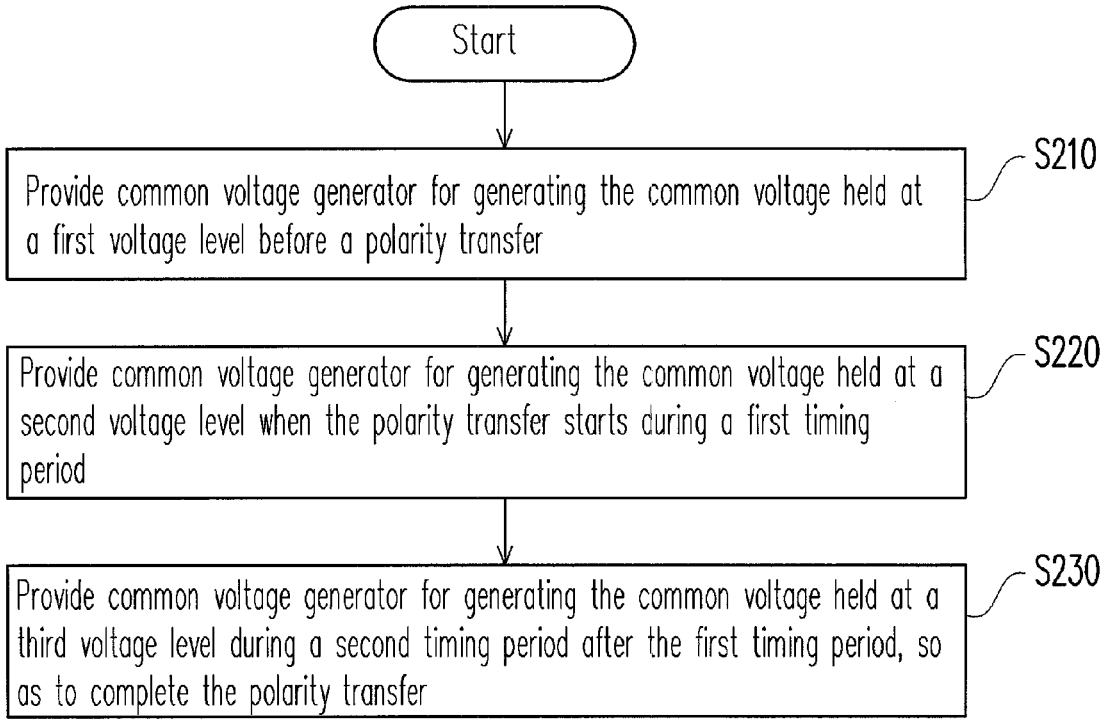
FIG. 2A is a flowchart of a driving method for an electro-phoretic display apparatus according to an embodiment of the invention.

Please refer to FIG. 2A, which is a flowchart of a driving method for an electro-phoretic display apparatus according to an embodiment of the invention. The electro-phoretic display apparatus (not drawn) includes a plurality of pixel units collectively receiving an alternating current (AC) common voltage, and each of the pixel units receives a pixel data signal. Moreover, a pixel driving voltage received by each of the pixel units is equal to a difference between a voltage value of the received pixel data signal and the common voltage. The driving method according to the present embodiment includes first using a common voltage generator to generate an AC common voltage. Moreover, before the electro-phoretic display apparatus performs polarity transfer, the common voltage provided by the common voltage generator is held at a first voltage level (Step S210). Here, the electro-phoretic display apparatus requires a cyclic polarity transfer. In brief, when driven by the AC common voltage, the common voltage also follows this polarity transfer and cyclically transfers from a low voltage level to a high voltage level, and transfers from the high voltage level to the low voltage level.

Thereafter, when the polarity transfer starts, the common voltage generator transfers the common voltage from a first voltage level to a second voltage value, and holds the common voltage at the second voltage level which is different from the first voltage level during a timing period (Step S220). A relationship between the first and second voltage levels is described as follows. When the polarity transfer performed in the Step S220 transfers the common voltage from the low voltage level to the high voltage level, then the second voltage level is higher than the first voltage level. Conversely, when the polarity transfer performed in the Step S220 transfers the common voltage from the high voltage level to the low voltage level, then the second voltage level is lower than the first voltage level.

After the timing period of the Step S220, the common voltage generator transfers the common voltage from the second voltage level to a third voltage level, and during another timing period, the common voltage generator holds the common voltage at the third voltage level (Step S230). The Step S220 may be further described as follows. When the polarity transfer performed transfers the common voltage from the low voltage level to the high voltage level, then the third voltage level is higher than the second voltage level. Conversely, when the polarity transfer performed transfers the common voltage from the high voltage level to the low voltage level, then the third voltage level is lower than the first voltage level.

Moreover, the timing period specified in the Step S230 is different from the timing period of the Step S220 and follows after the timing period of the Step S220. In addition, the timing period specified in the Step S230 is maintained until the next polarity transfer. It should be noted that two adjacent polarity transfer operations are complementary. In brief, when the common voltage is transferred from the high voltage level to the low voltage level in a first polarity transfer, then in a second polarity transfer, the common voltage is transferred from the low voltage level to the high voltage level.

Figure 2B:
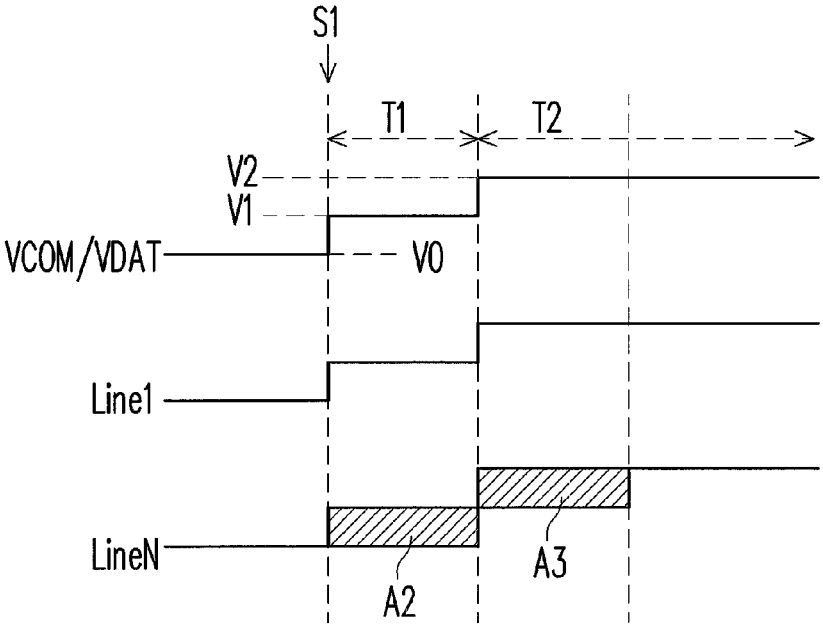
FIG. 2B is a waveform diagram according to an embodiment of the invention.

Please refer to FIG. 2B, which is a waveform diagram according to an embodiment of the invention. When a common voltage VCOM transitions at a time point S1 when the polarity transfer is started. At this time, the common voltage VCOM transitions from a voltage level V0 to a first voltage level V1. Moreover, the common voltage VCOM is maintained at the first voltage level V1 during a timing period T1. After the timing period T1, the common voltage VCOM transfers from the first voltage level V1 to a second voltage level V2. During a timing period T2, the common voltage VCOM is maintained at the second voltage level V2. The second voltage level V2 is a target high voltage level of the common voltage VCOM, whereas the voltage level V0 is a target low voltage level of the common voltage VCOM. The first voltage level V1 is a middle voltage level (i.e. V0<V1<V2) between the target high and low voltage levels of the common voltage VCOM.

Figure 1A:
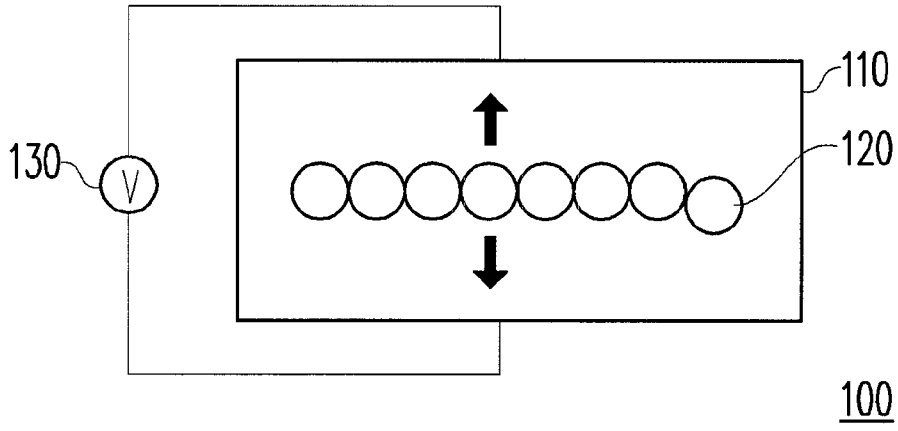
FIG. 1A (RELATED ART)
FIG. 1A is a schematic view of an electro-phoretic display apparatus.
Figure 1B:
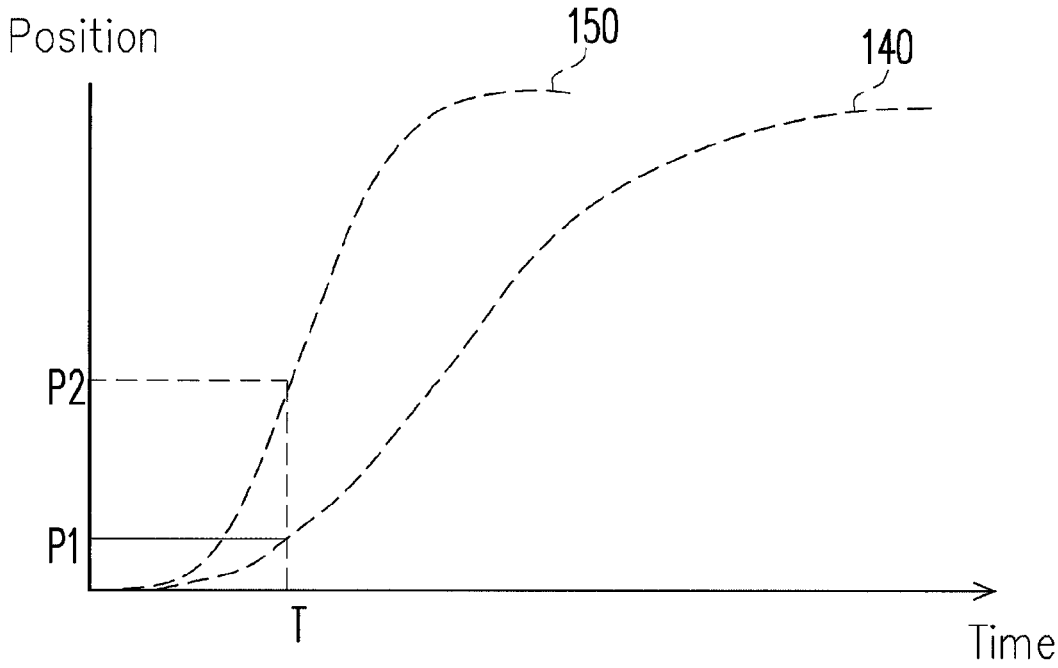
FIG. 1B (RELATED ART)
FIG. 1B is a relational diagram of particle position and time under different pixel driving voltages.
Figure 1C:
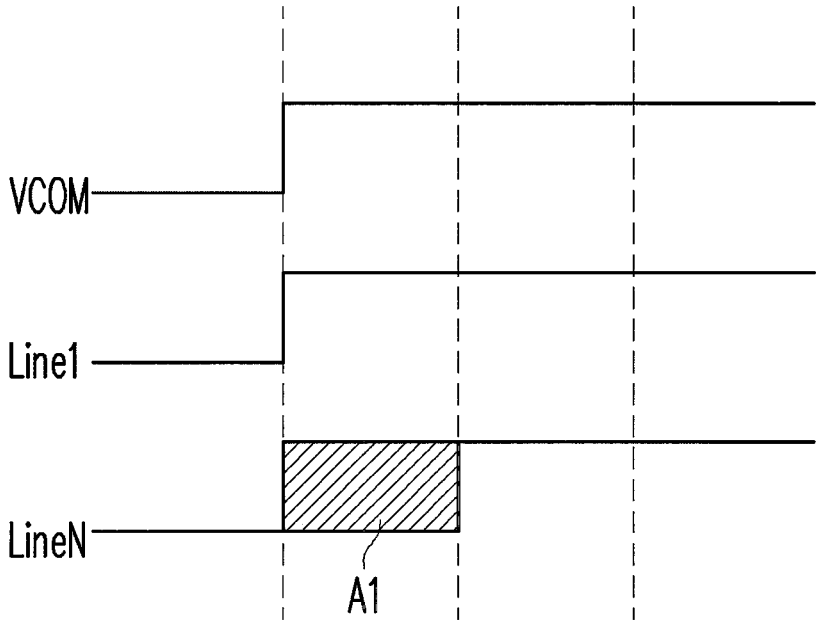
FIG. 1C (RELATED ART)
FIG. 1C is a waveform relational diagram of a common voltage and two pixel driving voltages of a conventional electro-phoretic display apparatus.

It should be noted that, under the driving method of the present embodiment, a voltage difference of a pixel driving voltage LineN of a $N^{th}$ row of the electro-phoretic display apparatus due to a time delay may be depicted by regions A2 and A3. Compared with the waveform depicted in FIG. 1C, the region A2 has been divided into regions A2 and A3. In other words, the voltage difference has been clearly lowered, and correspondingly the image fading phenomenon has been reduced.

Moreover, besides varying the transition methods of the common voltage VCOM, an embodiment of the invention may lower the pixel driving voltage received by the pixel unit by employing a transition method of a pixel data signal VDAT provided to the pixel unit. As shown in FIG. 2B, before the polarity transfer, the pixel data signal VDAT is maintained at an original voltage level V0. When the polarity transfer starts, the pixel data signal VDAT transfers from the original voltage level V0 to the middle voltage level V1. Moreover, during the timing period T1, the pixel data signal VDAT is maintained at the middle voltage level V1. After the timing period T1, the pixel data signal VDAT transitions from the middle voltage level V1 to a post-transition voltage level V2, so as to complete the polarity transfer operation. In addition, during the timing period T2 thereafter, the pixel data voltage VDAT is continually maintained at the post-transition voltage level V2.

The middle voltage level V1 is between the original voltage level V0 and the post-transition voltage level V2. Since the original voltage level V0 and the post-transition voltage level V2 vary according to the gray level displayed by the corresponding pixel unit, therefore the middle voltage level V1 may be calculated by using an average value of the original voltage level V0 and the post-transition voltage level V2.

It should be noted that, whether the afore-described two-stage common voltage VCOM or the transition method of the pixel data signal is used, the voltage difference of the pixel driving voltage on the pixel units can be effectively lowered, and the image fading phenomenon can be accordingly reduced. Naturally, the voltage difference of the pixel driving voltage on the pixel units can also be effectively lowered by applying the two-stage transition method simultaneously on the common voltage VCOM and the pixel data signal VDAT, and thereby reduce the image fading phenomenon accordingly.

Figure 3:
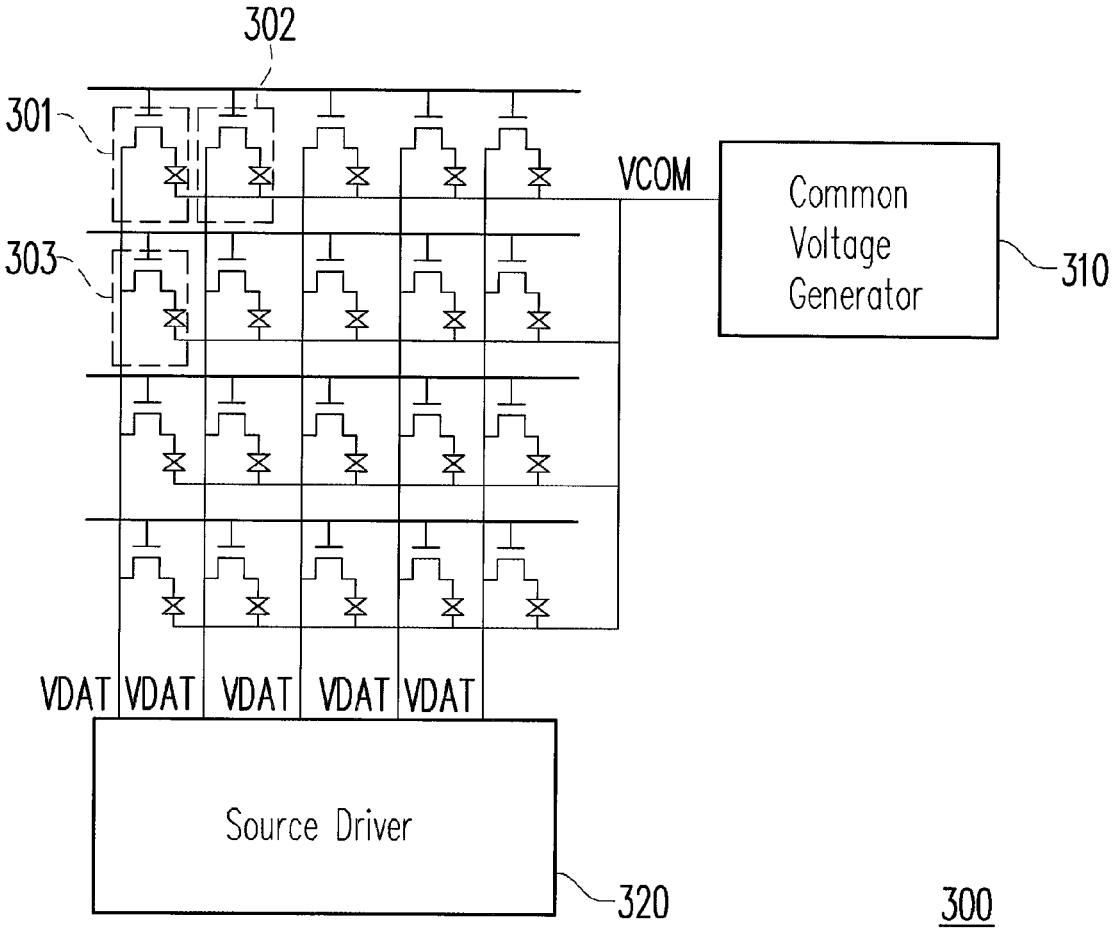
FIG. 3 is a schematic view of an electro-phoretic display apparatus according to an embodiment of the invention.

Please refer to FIG. 3, which is a schematic view of an electro-phoretic display apparatus according to an embodiment of the invention. The electro-phoretic display apparatus 300 includes a plurality of pixel units 301-303, a common voltage generator 310, and a source driver 320. The common voltage generator 310 is coupled to the pixel units 301-303, and is used for generating and providing an AC common voltage VCOM. The source driver 320 is also coupled to the pixel units 301-303, and is used for providing the pixel data signal VDAT. In the present embodiment, the common voltage generator 310 and the source driver 320 may separately or simultaneously provide the two-stage transition common voltage VCOM and the pixel data signal VDAT, so as to effectively lower the voltage difference of the pixel driving voltage on the pixel units, and thereby reduce the image fading phenomenon accordingly. The detailed description of the common voltage generator 310 and the source driver 320 providing the two-stage transition common voltage VCOM and the pixel data signal VDAT has been elaborated in the afore-described embodiments, therefore further description thereof is omitted hereafter.

In view of the foregoing, according to an embodiment of the invention, when a polarity transfer begins a transition of the common voltage or the pixel data signal, a full swing transition operation is not directly implemented. Rather, the common voltage or the pixel data first transitions to a middle level (i.e. second voltage). Accordingly, the voltage difference of the pixel driving voltage received on the pixel units can be effectively lowered, thereby reducing the image fading phenomenon and enhancing the display performance.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A driving method for an electro-phoretic display apparatus, wherein a plurality of pixel units of the electro-phoretic display apparatus collectively receive an alternating current (AC) common voltage, and each of the pixel units receives a pixel data signal, the driving method comprising:

providing a common voltage generator for generating the common voltage held at a first voltage level directly before a polarity transfer;

providing the common voltage generator for generating the common voltage held at a second voltage level when the polarity transfer starts during a first timing period;

providing the common voltage generator for generating the common voltage held at a third voltage level during a second timing period directly after the first timing period, so as to complete the polarity transfer, wherein the second voltage level is between the first voltage level and the third voltage level;

providing a source driver for generating the pixel data signals, the source driver generating each of the pixel data signals of an original voltage level before the polarity transfer;

generating each of the pixel data signals held at a middle voltage level during the first timing period, wherein each of the pixel data signals is held at the middle voltage level during the entire first timing period; and generating each of the pixel data signals held at a post-transition voltage level during the second timing period, so as to complete the polarity transfer, wherein the middle voltage level is between the original voltage level and the post-transition voltage level, and each of the pixel data signals is held at the post-transition voltage level during the entire second timing period, wherein before the polarity transfer, if the common voltage is less than the second voltage level, then the pixel data signals are less than the middle voltage level, wherein during the second timing period, if the common voltage is higher than the second voltage level, then the pixel data signals are higher than the middle voltage level.

2. The driving method as claimed in claim 1, wherein the first voltage level is higher than the third voltage level, or the third voltage level is higher than the first voltage level, wherein the post-transition voltage level is higher than the original voltage level when the third voltage level is higher than the first voltage level, and the post-transition voltage level is less than the original voltage level when the third voltage level is less than the first voltage level, wherein a transition of the common voltage is synchronous with that of the pixel data signals.

3. An electro-phoretic display apparatus, comprising:

a plurality of pixel units collectively receiving an AC common voltage, and each of the pixel units receives a pixel data signal;

a common voltage generator coupled to the pixel units for generating the common voltage held at a first voltage level directly before a polarity transfer, generating the common voltage held at a second voltage level when the polarity transfer starts during a first timing period, and generating the common voltage held at a third voltage level during a second timing period directly after the first timing period, so as to complete the polarity transfer, wherein the second voltage level is between the first voltage level and the third voltage level; and a source driver coupled to the pixel units for generating the pixel data signals, wherein the source driver generates each of the pixel data signals of an original voltage level before the polarity transfer, generates each of the pixel data signals held at a middle voltage level during the first timing period, and generates each of the pixel data signals held at a post-transition voltage level during the second timing period, so as to complete the polarity transfer, wherein the middle voltage level is between the original voltage level and the post-transition voltage level, wherein each of the pixel data signals is held at the middle voltage level during the entire first timing period, wherein each of the pixel data signals is held at the post-transition voltage level during the entire second timing period, wherein before the polarity transfer, if the common voltage is less than the second voltage level, then the pixel data signals are less than the middle voltage level, wherein during the second timing period, if the common voltage is higher than the second voltage level, then the pixel data signals are higher than the middle voltage level.

4. The electro-phoretic display apparatus as claimed in claim 3, wherein the first voltage level is higher than the third voltage level, or the third voltage level is higher than the first voltage level, wherein the post-transition voltage level is higher than the original voltage level when the third voltage level is higher than the first voltage level, and the post-transition voltage level is less than the original voltage level when the third voltage level is less than the first voltage level, wherein a transition of the common voltage is synchronous with that of the pixel data signals.

* * * * *